US008128369B2

(12) United States Patent
Jarrah et al.

(10) Patent No.: US 8,128,369 B2
(45) Date of Patent: Mar. 6, 2012

(54) BLOWER IMPELLER WITH PARTIAL TIP BLOCKAGE

(75) Inventors: Yousef Jarrah, Casa Grande, AZ (US); Hanson Situ, Scottsdale, AZ (US); Thang Nguyen, Gilbert, AZ (US)

(73) Assignee: Minebea Co., Ltd., Tokyo (JP)

( * ) Notice: Subject to any disclaimer, the term of this patent is extended or adjusted under 35 U.S.C. 154(b) by 289 days.

(21) Appl. No.: 12/103,575

(22) Filed: Apr. 15, 2008

(65) Prior Publication Data

US 2009/0257876 A1 Oct. 15, 2009

(51) Int. Cl.
*F01D 5/22* (2006.01)

(52) U.S. Cl. ..... 416/178; 416/185; 416/187; 415/228

(58) Field of Classification Search ..... 415/228; 416/178, 179, 182, 183, 185, 186 R, 187
See application file for complete search history.

(56) References Cited

U.S. PATENT DOCUMENTS

| | | | | |
|---|---|---|---|---|
| 4,231,706 | A * | 11/1980 | Ueda et al. | 416/186 R |
| 5,304,033 | A * | 4/1994 | Tang | 415/206 |
| 6,007,300 | A * | 12/1999 | Saeki et al. | 416/178 |
| 6,893,220 | B2 * | 5/2005 | Eaton et al. | 415/206 |
| 7,108,482 | B2 * | 9/2006 | Chapman | 416/185 |
| 7,281,897 | B2 * | 10/2007 | Ochiai et al. | 416/184 |

* cited by examiner

*Primary Examiner* — Edward Look
*Assistant Examiner* — Liam McDowell
(74) *Attorney, Agent, or Firm* — George B. F. Yee; Fountainhead Law Group PC

(57) ABSTRACT

According to embodiments of the invention, an impeller includes a hub, and a plurality of radial blades for drawing the air inflow axially through the hub and delivering the drawn air radially towards the outside. A ring is attached to one or more tips of the plurality of radial blades to block a portion of the tip toward the inlet side of the impeller. The preferred blockage factor, which is the ratio of a height of the ring to a height of the tip, is approximately in a range between 30% and 40%. By blocking a portion of the tip toward the inlet side of the impeller, the low-momentum flow zone toward the inlet side of impeller is blocked, while the high-momentum flow zone toward the back side of impeller is enhanced. As such, the performance of the impeller is enhanced.

12 Claims, 6 Drawing Sheets

100

BLOWER IMPELLER WITH PARTIAL TIP BLOCKAGE

BACKGROUND OF THE INVENTION

This invention relates generally to blower impellers and in particular to blower impellers with improved pressure production capability.

It is well known that a blower impeller has a central hub arranged to be mounted on a motor shaft. A set of radial blades are arranged on the hub and configured to draw air axially into the interior of the hub and to deliver it radially towards the outside.

There are generally two flow zones within such an impeller: a low-momentum zone toward the inlet side of the impeller and a high-momentum zone toward the back side of the impeller. This flow distribution profile creates an non-uniform air flow, which degrades performance.

BRIEF SUMMARY OF THE INVENTION

One of the objects of the invention is to enhance the pressure production capability of the impeller and to reduce the tonal noise associated with the blade passing frequency.

According to embodiments of the invention, an impeller includes a hub, and a plurality of radial blades for drawing in the air axially through the hub and delivering the drawn air radially towards the outside. A ring is attached to one or more tips of the plurality of radial blades to block a portion of the tip toward the inlet side of the impeller. The preferred blockage factor, which is the ratio of a height of the ring to a height of the tip, is approximately in a range between 30% and 40%. By blocking a portion of the tip toward the inlet side of the impeller, the low-momentum flow zone toward the inlet side of the impeller is blocked, while the high-momentum flow zone toward the rear or back side of the impeller is enhanced. As such, the pressure production capability of the impeller is enhanced.

The partial tip blockage arrangement also results in one or more expansion regions formed at the impeller-tip volute-inlet interface. This in effect makes the ring function as a diffuser to produce pressure efficiently, and as a muffler to reduce tonal noise associated with the blade passing frequencies.

Other features and advantages of the present invention will be apparent from the accompanying drawings and from the detailed description that follows below.

DETAILED DESCRIPTION OF THE INVENTION

Figure 1:
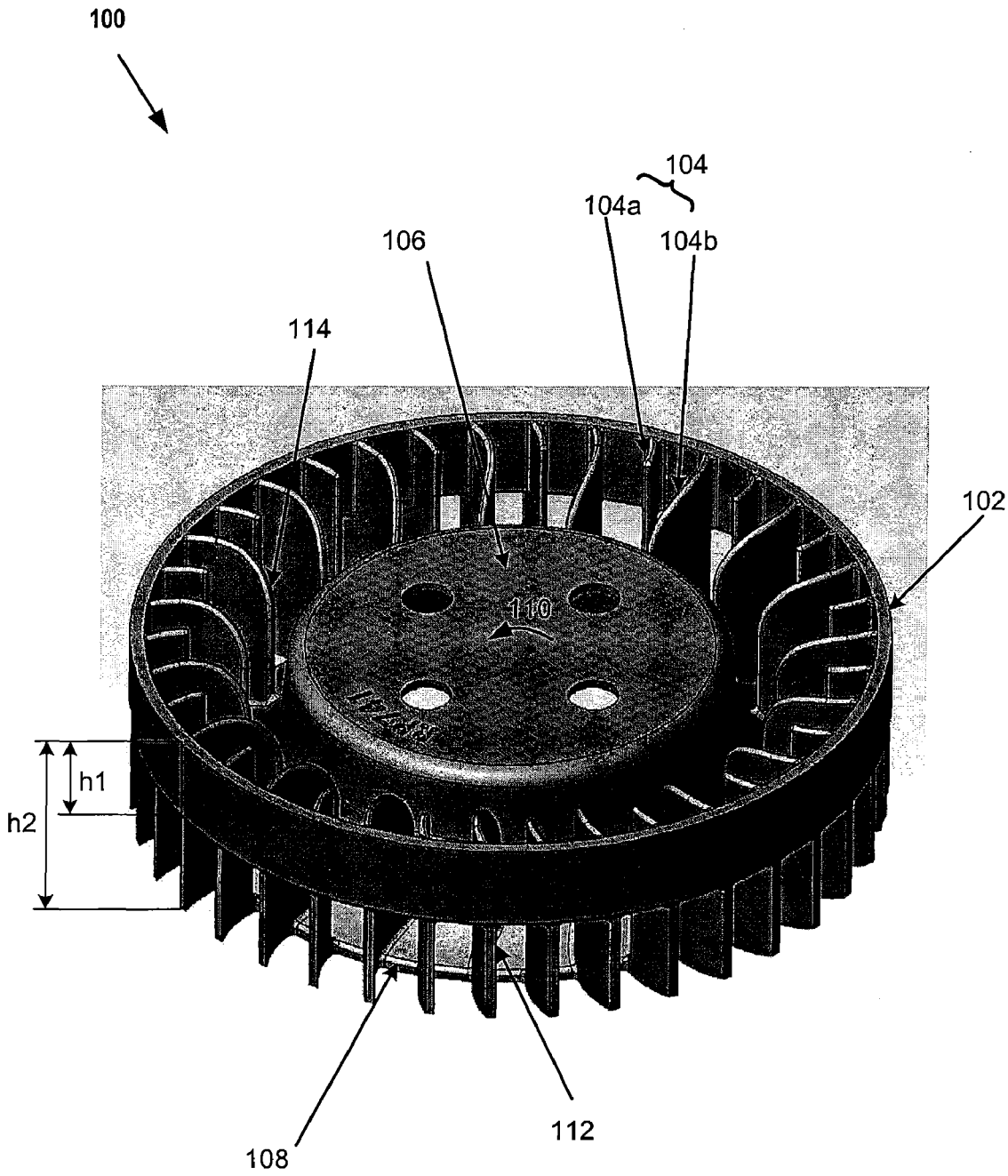
FIG. 1 illustrates an example impeller according to embodiments of the invention.
Figure 2:
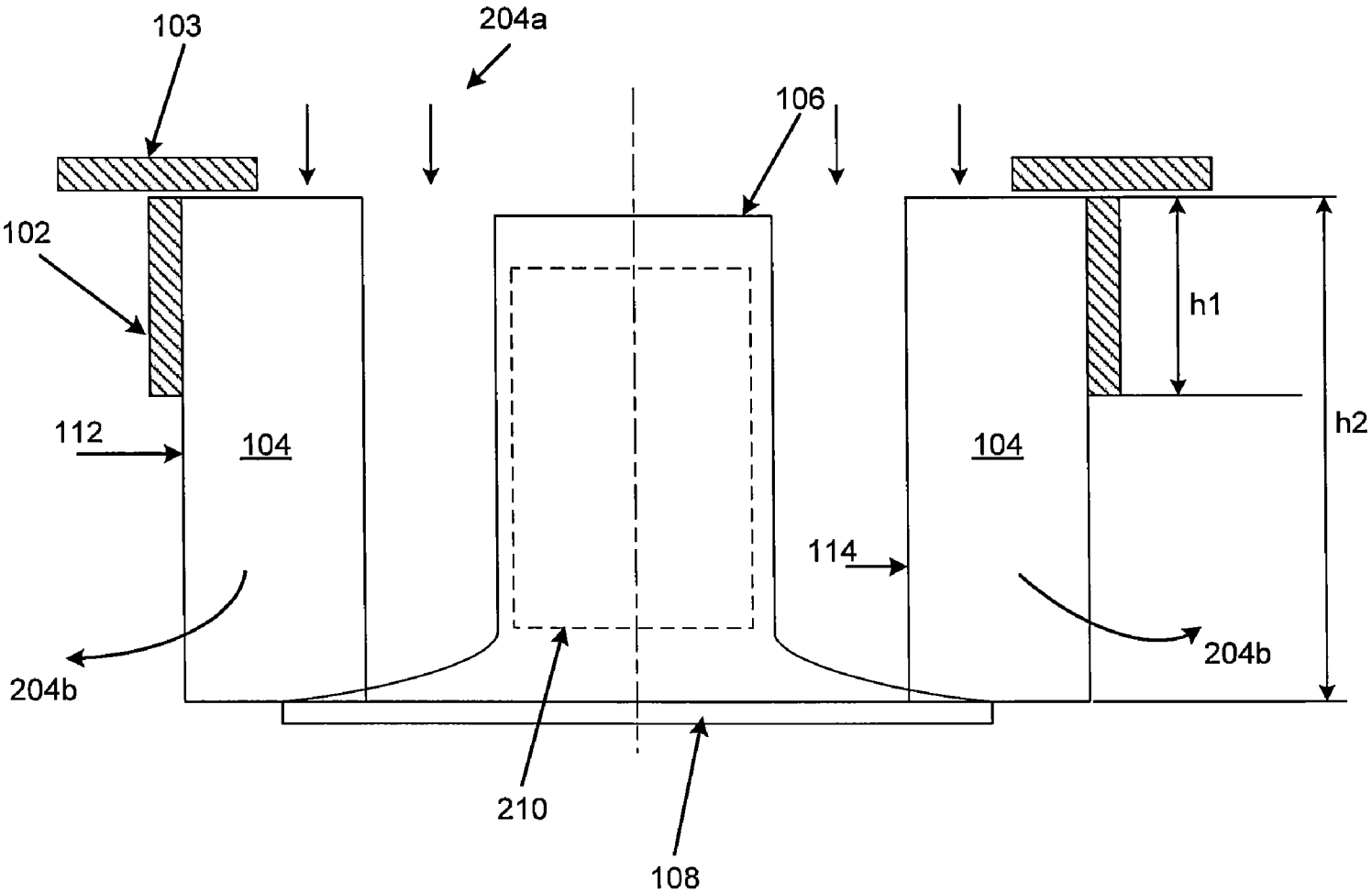
FIG. 2 illustrates a cross-section view of the impeller in FIG. 1.

FIG. 1 illustrates an example impeller according to embodiments of the invention. FIG. 2 illustrates a cross-section view of the impeller in FIG. 1.

Referring to FIGS. 1 and 2, impeller 100 includes drive motor 210 (indicated in FIG. 2 with phantom lines) and a hub 106 into which drive motor 210 is securely fitted. A plurality of radial blades 104 are attached and disposed about a base 108 of the hub 106. Radial blades 104 may be of varying chord length, such as splitter blades 104*a* and full blades 104*b* shown in FIG. 1. These varying-length radial blades 104, together with the tip ring 102 (which will be discussed below), reduce the tonal noise associated with the blade passing frequency.

When impeller 100 rotates in a direction indicated by arc 110, radial blades 104 capture the axially-directed air inflow 204*a* (as shown in FIG. 2) that enters an opening on the inlet side of the impeller via hub 106, and redirect the air inflow in a radial direction 204*b* (as shown in FIG. 2) toward the back side of the impeller.

A ring structure 102 is attached to a tip 112, also known as the trailing edge (TE), of radial blades 104 toward the inlet side of impeller 100 where the low-momentum air is being centrifuged (shown as the top side in FIG. 1). That is, ring 102 is disposed about a portion of tip 112 toward the inlet side of impeller 100, such that a height h1 of ring 102 is less than a height h2 of tip 112. The preferred blockage factor, which is defined as the ratio of the height h1 to the height h2, is approximately in a range between 30% and 40%. Also depicted in FIG. 2 are an inlet cover 103 that covers portions of radial blades 104 to partially block the air 204*a*, and a leading edge 114 of radial blades 104.

By partially blocking the tip of the impeller blades toward the inlet side of the impeller using ring 102, a more coherent airflow is formed inside the impeller. As such, only the low-momentum flow zone toward the inlet side of impeller 100 is blocked, while the high-momentum flow zone toward the back side of impeller 100 is enhanced, and thus enhancing the pressure production capability of the impeller.

Figure 5:
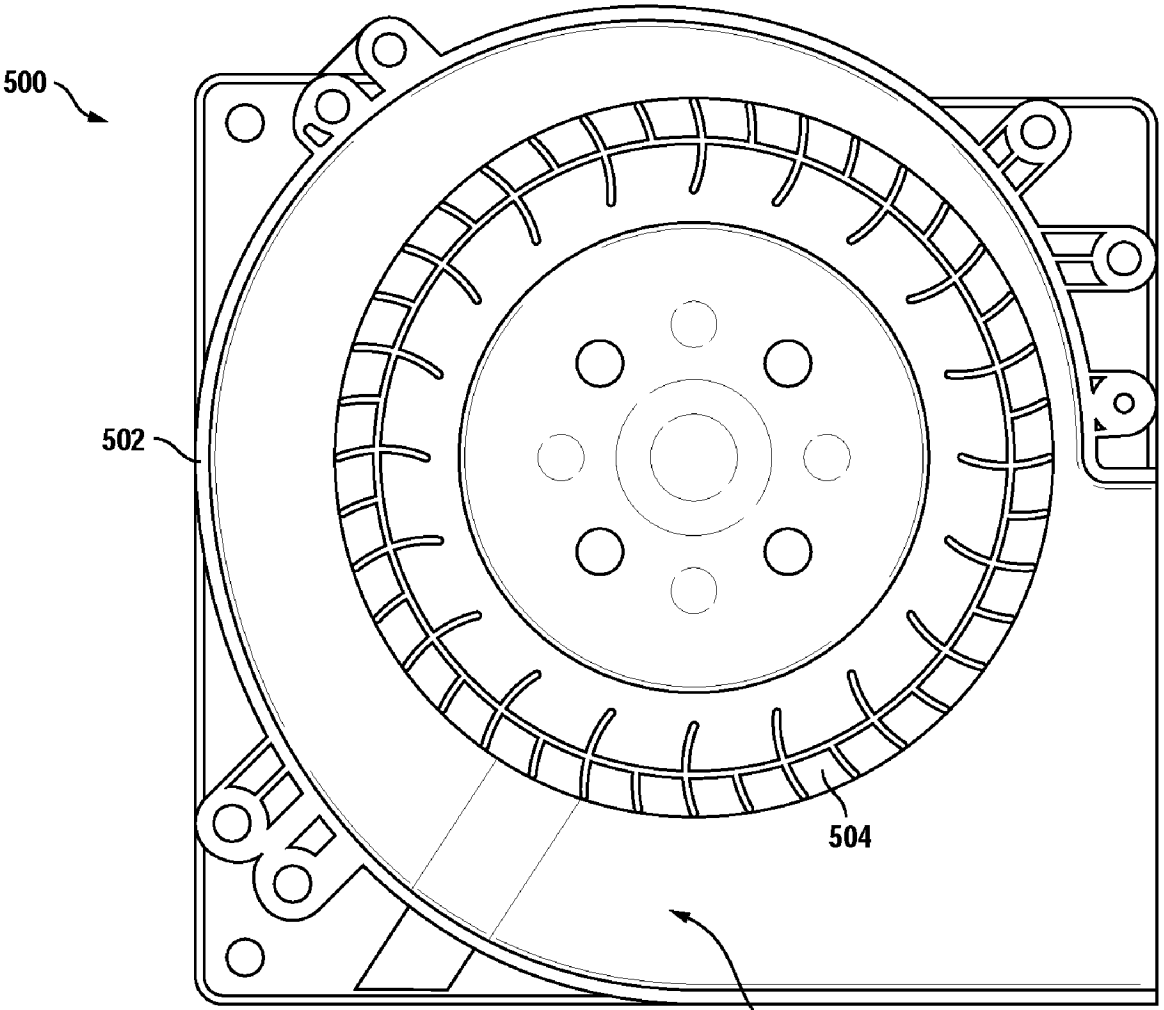
FIG. 5 further illustrates a blower impeller according to embodiments of the invention.

For example, when impeller 100 rotates in the direction indicated by arc 110, axially-directed air inflow 204*a* is first captured toward the inlet side of impeller 100, then directed toward the back side of blades 104, and then centrifuged into the volute, which is the stationary part of the impeller housing, such as 506 as shown in FIG. 5.

The partial tip blockage arrangement results in one or more expansion regions formed at the impeller-tip volute-inlet interface. This in effect makes ring 102 function as a diffuser to produce pressure efficiently, and as a muffler to reduce tonal noise associated with the blade passing frequencies.

One of the advantages of the above-described ring structure is the elimination/reduction of the low-momentum flow zone (i.e., the low-momentum air toward the inlet side of the impeller) and the enhancement of the high-momentum flow zone (i.e., the high-momentum air toward the back side of the impeller). Without such a ring, there will be two flow zones within the impeller, and that degrades performance.

Figure 3:
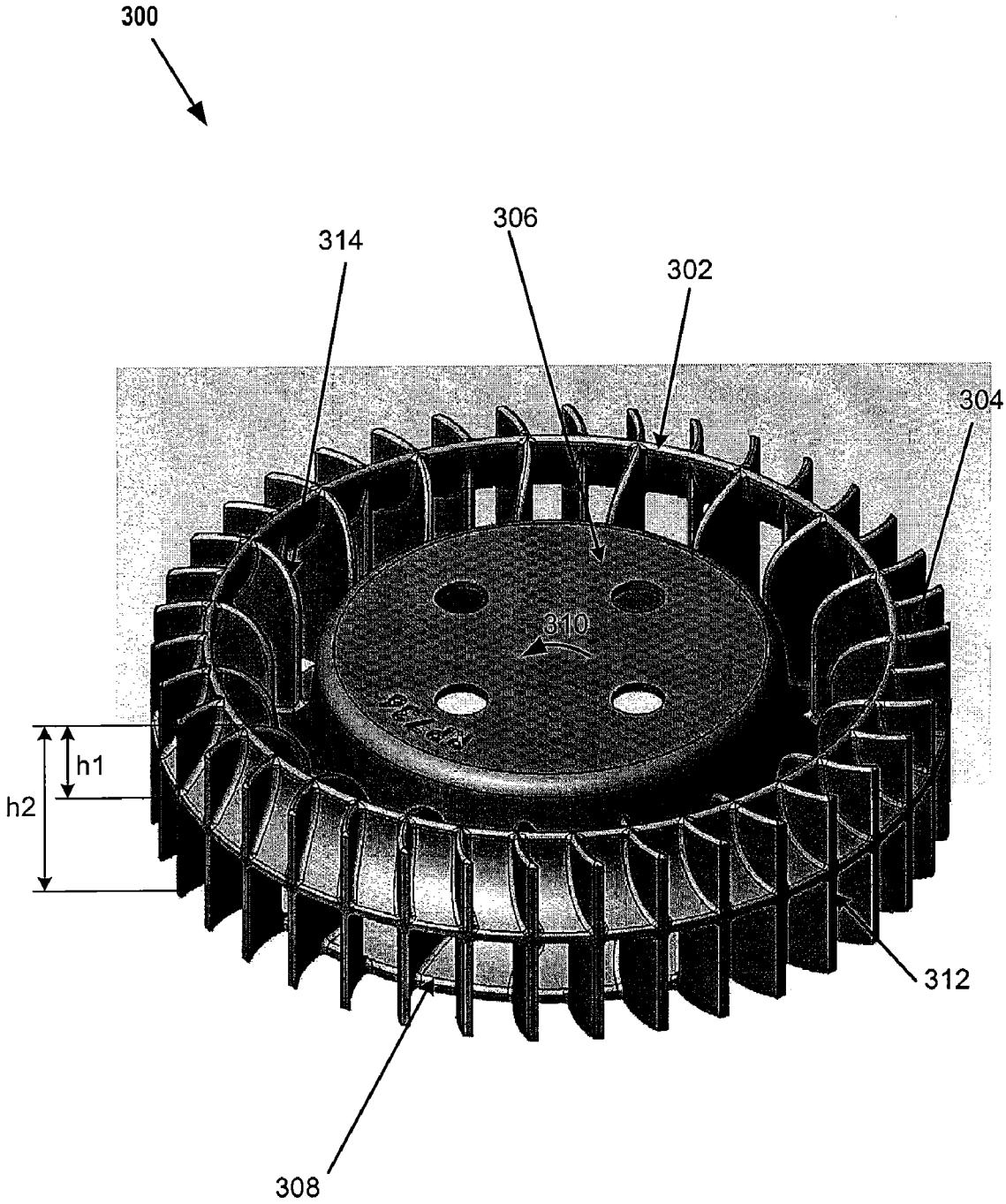
FIG. 3 illustrates another example impeller according to embodiments of the invention.
Figure 4:
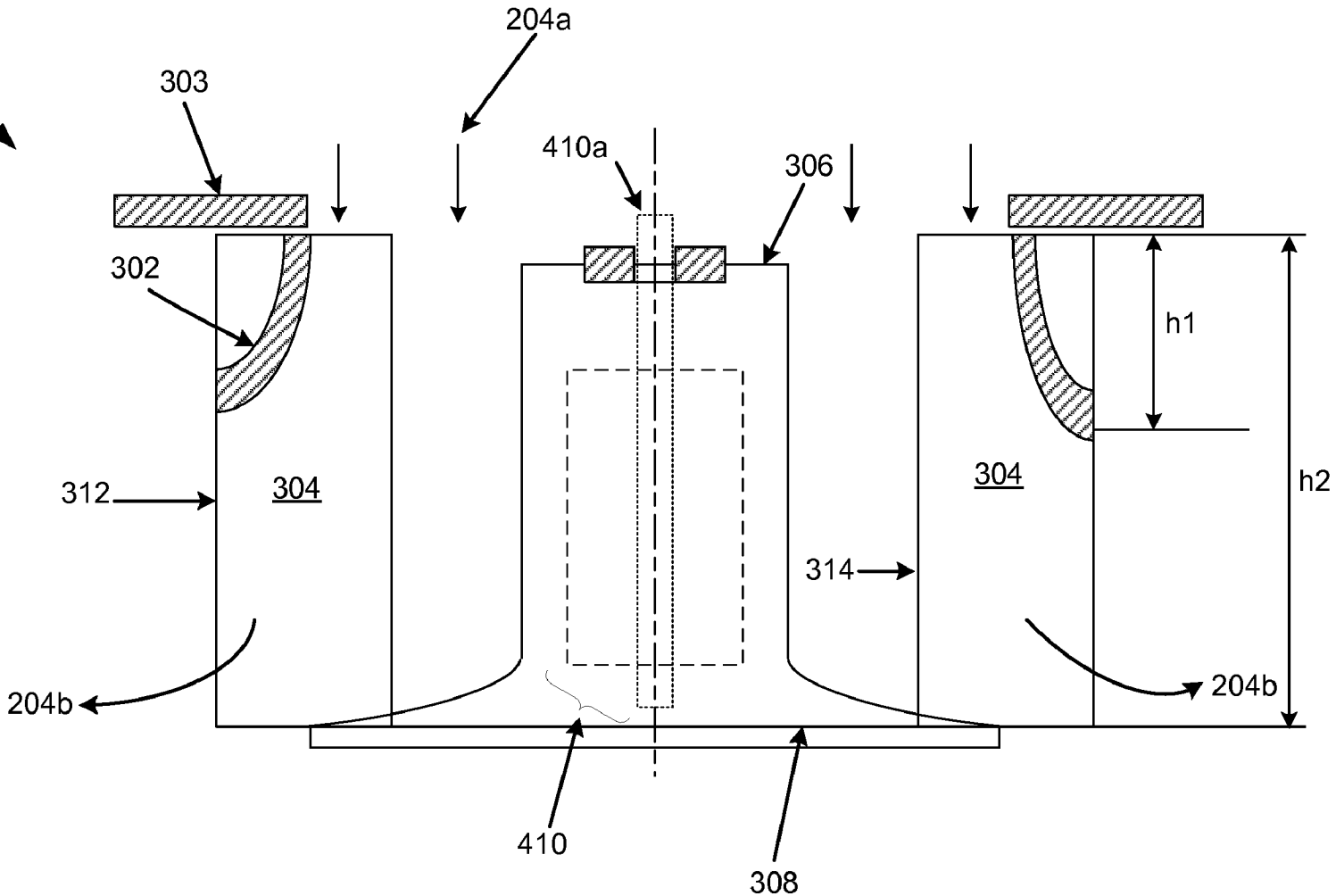
FIG. 4 illustrates a cross-section view of the impeller in FIG. 3.

FIG. 3 illustrates another example impeller according to embodiments of the invention. FIG. 4 illustrates a cross-section view of the impeller in FIG. 3.

Referring to FIGS. 3 and 4, the configuration of impeller 300 is similar to that of impeller 100, except for the configuration of the ring structure. Specifically, impeller 300 includes a concave-shaped ring 302 having a smaller diameter on a top side of the ring as compared to the diameter toward the bottom side of the ring.

Similar to ring 102 of FIG. 1, ring 302 is disposed about a portion of the tip or trailing edge 312 of blades 304 are attached to a base 308 of a hub 306 towards the inlet side of impeller 300 so as to block only the low-momentum flow zone toward the inlet side of the impeller, while enhancing the high momentum flow zone toward the back side of the impeller. The preferred blockage factor, which is defined as the ratio of a height h1 of ring 302 to a height h2 of tip 312, is approximately in a range between 30% and 40%. Also depicted in FIG. 4 are an inlet cover 303 that covers portions of radial blades 304 to partially block the air 204*a*, and a leading edge 314 of radial blades 304.

The embodiment of FIG. 4 also illustrates the use of an alternative motor configuration, namely the use of a brushed DC motor 410. Here, the rotating shaft 410*a* of the motor 410 is attached to the hub 306.

Figure 6:
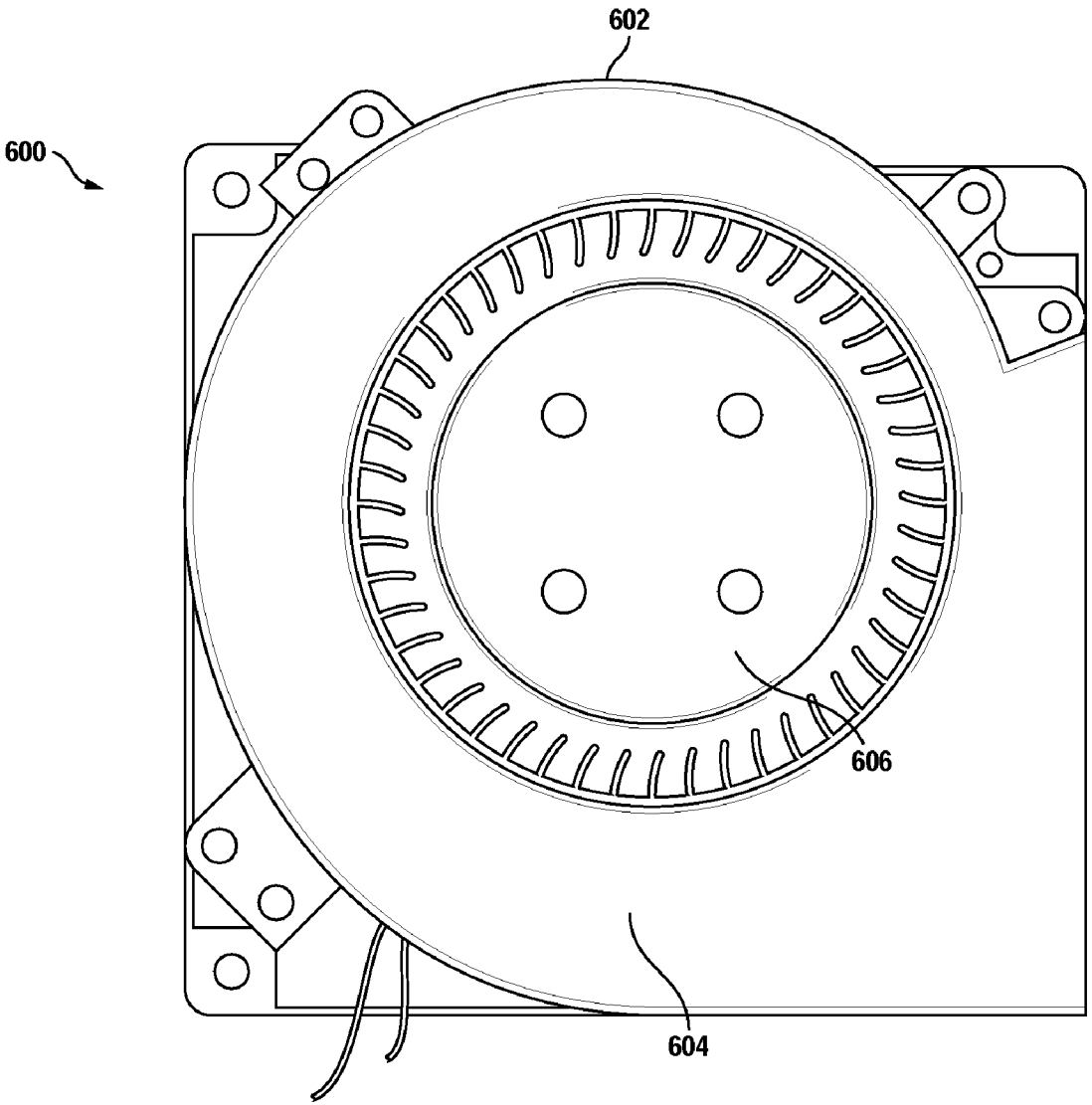
FIG. 6 further illustrates a blower impeller according to embodiments of the invention.

FIGS. 5 and 6 further illustrate a blower impeller according to embodiments of the invention.

The embodiment of FIG. 5 illustrates a fan 500 comprising a blower impeller 504 with a typical housing 502, and a volute 506, but without an inlet cover.

The embodiments of FIG. 6 illustrates a fan 600 comprising a blower impeller 606 with a typical housing 602, and an inlet cover 604 that partially covers the impeller blades.

The various components depicted in FIGS. 1-6 are merely examples of components that may be included in an impeller. In alternative embodiments, the impeller may have less or more components than those shown in FIGS. 1-6. In addition, the above-described impellers may be used with different types of electric motors that are well-known in the art, such as brushed electric motors, brushless electric motors, and/or the like.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An impeller comprising:

a hub;

a plurality of blades attached to and radially disposed about the hub, each blade having a trailing edge that runs parallel to an axis of rotation of the hub;

a ring to which all of the blades are attached, the ring comprising a single annular member having an inlet side and an outlet side, the inlet side of the ring being disposed in coplanar relation with an inlet side of the impeller, the ring having a concave profile wherein a diameter at the inlet side thereof is smaller than a diameter at the outlet side thereof, wherein a portion of the trailing edge of each of the blades proximate the inlet side of the impeller extends through first and second opposing major surfaces of the ring, wherein a height of the ring is less than a height of each blade, wherein the ring blocks a low-momentum flow zone toward the inlet side of the impeller, wherein an outer circumference of the ring is substantially co-extensive with trailing edges of the blades.

2. The impeller of claim 1 wherein the radial blades are adapted to draw an axially-directed air inflow that enters an opening on the inlet side of the impeller via the hub, and to direct the air inflow in a radial direction toward a back side of the impeller.

3. The impeller of claim 1 wherein each of the radial blades has a trailing edge and a leading edge.

4. The impeller of claim 3 wherein the ring is disposed about the trailing edge of each radial blade and toward the inlet side of the impeller, the ring having a height less than a height of the trailing edge.

5. The impeller of claim 4 wherein the height of the ring is approximately between 30% and 40% of the height of the trailing edge.

6. The impeller of claim 1 further comprising at least one expansion zone between the impeller and a base of the impeller.

7. The impeller of claim 1 wherein the covered portion of the tip has a height that is approximately between 30% and 40% of a height of the tip.

8. A blower impeller comprising:

a hub;

a plurality of blades attached to and radially disposed about the hub, each radial blade having a trailing edge and a leading edge; and a ring to which all of the blades are attached, the ring comprising a continuous annular member having an inlet side and an outlet side, the inlet side of the ring being disposed in coplanar relation with an inlet side of the impeller, wherein a diameter at the inlet side of the ring is smaller than a diameter at the outlet side of the ring, the ring further having a convex first major surface and an opposing concave second major surface, wherein a portion of the trailing edge of each of the blades proximate the inlet side of the impeller extends through the first and second major surfaces of the ring, wherein a height of the ring is less than a height of each blade, so as to partially block the trailing edge of each blade, wherein an outer circumference of the ring is substantially co-extensive with trailing edges of the blades.

9. The blower impeller of claim 8 wherein the ring has a height that is approximately between 30% and 40% of a height of the trailing edge.

10. The blower impeller of claim 8 wherein the ring is attached to one or more tips of the plurality of blades and toward an inlet side of the impeller such that only a portion of the tip is covered by the ring, the covered portion of the tip having a height that is approximately between 30% and 40% of a height of the tip.

11. The blower impeller of claim 8 wherein the ring is adapted to suppress tonal noise associated with blade passing frequencies due to one or more expansion zones formed between the impeller and a base of the impeller.

12. The blower impeller of claim 8, further comprising an inlet cover to cover a portion of the radial blades.

* * * * *